United States Patent [19]

Zownir

[11] Patent Number: 4,471,824

[45] Date of Patent: Sep. 18, 1984

[54] TOOL FOR SQUARING CUE STICK FERRULE AND SHAPING CUE TIP

[76] Inventor: Michael Zownir, 418 Monroe St., Albuquerque, N. Mex. 87108

[21] Appl. No.: 548,324

[22] Filed: Nov. 3, 1983

[51] Int. Cl.[3] ..... A63D 15/14

[52] U.S. Cl. ..... 144/330; 144/134 R; 51/241 S; 51/205 R; 273/70

[58] Field of Search ..... 144/28.11, 28.2, 30, 144/114 R, 114 A, 134 D, 330; 51/241 S, 172, 241 VS, 205 R; 273/70, 71

[56] References Cited

U.S. PATENT DOCUMENTS 1,259,136 3/1918 Rogers ..... 51/205 R 3,468,068 9/1969 Spruell ..... 51/205 R

*Primary Examiner*—Lowell A. Larson

*Assistant Examiner*—Jorji M. Griffin

*Attorney, Agent, or Firm*—Harvey B. Jacobson

[57] ABSTRACT

A generally cylindrical sleeve is provided defining a bore extending longitudinally therethrough. The end of the bore opening outwardly through one end of the sleeve is outwardly flared and the other end of the sleeve is externally threaded. An internally threaded cap is threadedly engaged over the second end of the sleeve and defines an end wall removably closing the end of the bore opening outwardly through the second end. The inner side of the end wall is partial concave spherical and defines a concave recess opening toward the sleeve first end. A rigid disc having an abrasive disc abutted thereagainst may be clamped between the second end of the sleeve and the outer periphery of the end wall and the first end of the sleeve may be telescoped over a cue stick ferrule and the sleeve and cue stick may thereafter relatively rotated in order to abrasively clean and square the ferrule. Thereafter, a cue tip may be mounted on the ferrule and the rigid disc and first mentioned abrasive disc may be removed and replaced by a second abrasive disc whose center portion may be deflected into the end wall recess before retightening of the cap on the second end of the sleeve to retain the second disc in its deflected concavo-convex configuration. Thereafter, the end of the cue stick having the new tip mounted thereon may be inserted into the sleeve and rotated relative thereto in order to abrasively shape the end face of the cue tip into an convex partial spherical configuration.

8 Claims, 9 Drawing Figures

32
38
40
50
26
30
22

34
36
38
40
50
20
12
28
10

32
52
46
42
44
28
26
30
22
24
56
12
10

52
32
56
22
20
12
10

56
12
10

TOOL FOR SQUARING CUE STICK FERRULE AND SHAPING CUE TIP

BACKGROUND OF THE INVENTION

Various different forms of tools have been provided for installing new tips on cue sticks, squaring the end face of a cue stick ferrule upon which a cue tip is to be mounted and shaping the outer end of the cue tip after it has been mounted. In addition, while some of these previously known tools are portable, the most efficient tools for reconditioning a cue tip ferrule, mounting a tip thereon and shaping the outer face of the tip are not of the truly portable type. Accordingly, while reasonably portable and relatively usable clamps are available for maintaining a cue tip in clamped position on a cue stick ferrule while associated attaching adhesive dries or other wise cures, a need exists for a portable tool which may be readily utilized to clean and square a cue tip ferrule and to shape the outer face of a cue tip after it has been secured to a cue stick ferrule.

Examples of various different forms of cue stick tip reconditioning tools including some of the general structural and operational features of the instant invention are disclosed in U.S. Pat. Nos. 60,503, 153,433, 285,360 and 4,321,737.

BRIEF DESCRIPTION OF THE INVENTION

The tool of the instant invention includes a sleeve having first and second ends and defining a longitudinal bore formed therethrough. The end of the bore which opens outwardly through the first end of the sleeve is slightly flared and the second end of the sleeve is externally threaded. An internally threaded cap is removably threadedly engageable over the sleeve second end and defines an end wall closing the sleeve second end. The inner surface of the end wall is equipped with a concave partial spherical recess and the outer periphery of an abrasive disc may be clamped between the sleeve second end and the outer peripheral portions of the end wall after the disc has been deflected to conform to the concavity of the recess in the end wall. The first end of the sleeve may then be telescoped over the tip end of a cue stick having had a new tip mounted thereon and the body, comprising the sleeve and the cap, may then be rotated relative to the cue stick in order to properly shape the outer surface of the cue tip so as to be convex spherical. On the other hand, a rigid disc having an abrasive disc abutted thereagainst may be clamped between the second end of the sleeve and the outer periphery end wall of the cap in lieu of the first mentioned abrasive disc and the tip end of a cue stick to have a new tip applied thereto may be telescoped into the first end of the bore after which the body comprising the tool may be rotated relative to the cue stick in order to clean and square the tip mounting face of the ferrule carried by the end of the cue stick. Thus, a simple, highly portable and readily usable tool is provided for use in reconditioning a cue stick tip end.

The main object of this invention is to provide a tool (for use in conjunction with readily available and defective clamps for use in clamping a cue stick tip to a cue stick ferrule during a gluing operation) for squaring a cue stick ferrule prior to glueing a cue tip thereto and shaping the tip after the tip has been secured to the ferrule.

Another object of this invention is to provide a tool in accordance with the preceding object and which is highly portable and extremely effective in performing its intended functions.

Still another object of this invention is to provide a tool which may be used effectively even by inexperienced persons.

A final object of this invention is to provide a tool in accordance with the preceding objects and which will conform to conventional forms of manufacture be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
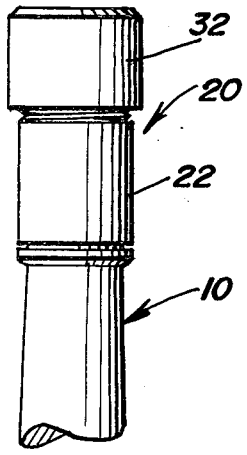
FIG. 1 is a fragmentary side elevational view of the tip end portion of a cue stick and with the tool of the instant invention operatively associated therewith.
Figure 3:
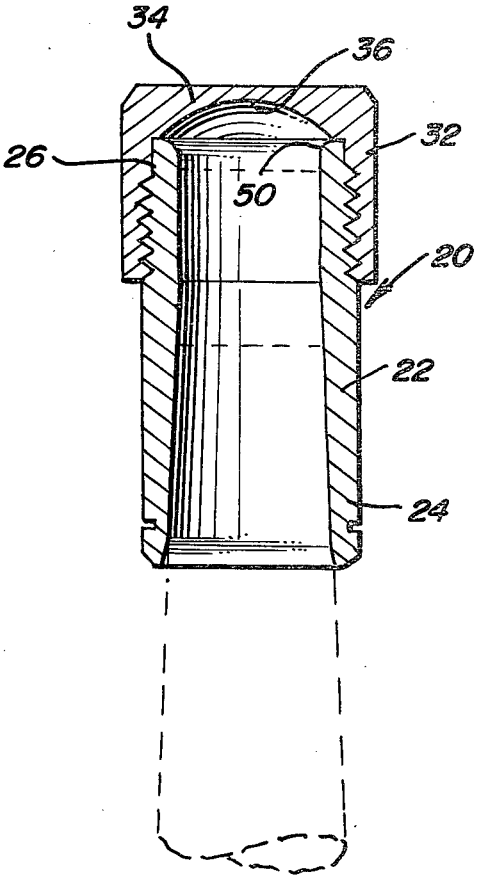
FIG. 3 is an enlarged longitudinal sectional view of the sleeve and end cap portions of the body of the tool in assembled relations.
Figure 2:
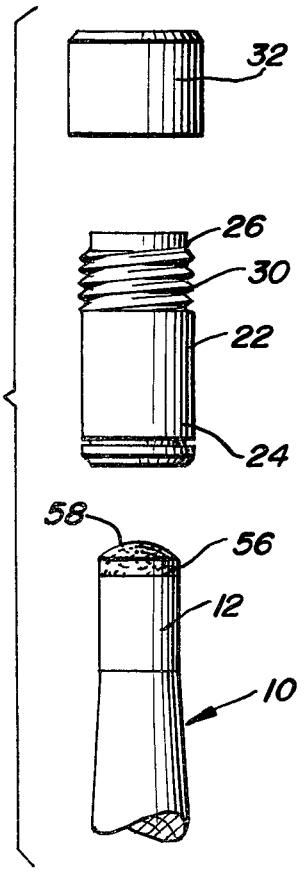
FIG. 2 is a fragmentary side elevational view similar to FIG. 1 but with the tool components in exploded position relative to the cue stick.
Figure 4:
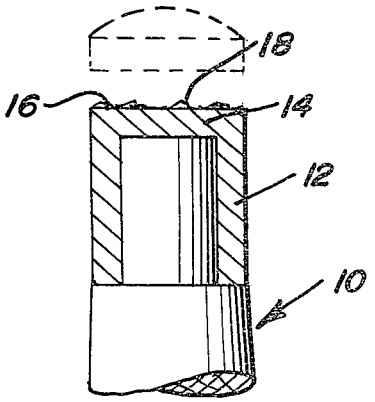
FIG. 4 is a fragmentary elevational view of the tip end of a cue stick with the tip removed and the ferrule illustrated in longitudinal section before having the end face of the ferrule squared by the tool of the instant invention for receiving a cue tip, the latter being illustrated in phantom lines.
Figure 5:
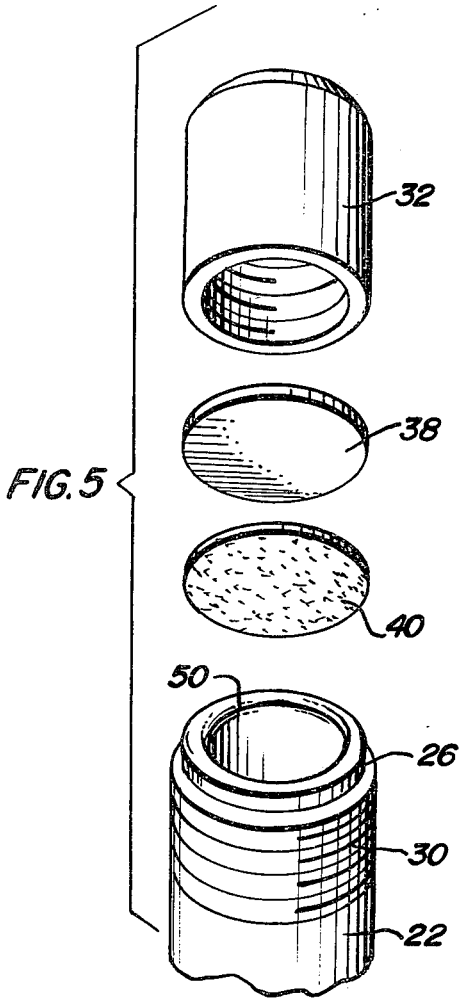
FIG. 5 is an exploded perspective view of the tool and its components before being assembled for the purpose of squaring a cue tip ferrule end face.

Referring now more specifically to the drawings, the numeral 10 generally designates a cue stick having a ferrule 12 mounted on its tip end. The ferrule 12 includes an end wall 14 whose outer face 16 usually has glue or other adhesive remnants 18 thereon when a cue tip is dislodged from the end of the cue stick 10.

The tool of the instant invention is referred to in general by the reference numeral 20 and has, as one of its function, the removal of the remnants 18 and the squaring of the outer end face 16 of the end wall 14 preparatory to the securement of a new cue tip thereto.

The tool 20 comprises a two-piece body including a sleeve 22 having first and second ends 24 and 26 and defining a longitudinal bore 28 extending therethrough. The end of the bore 28 opening outwardly from the first end 24 of the sleeve 22 is slightly outwardly flaired and the second end 26 of the sleeve 22 is externally threaded as at 30. In addition, the body comprising the tool 20 also includes an internally threaded end cap 32 which defines an end wall 34 for closing the second end 26 of the sleeve 22 when the cap 32 is threaded on the second end of the sleeve 22.

The inner surface of the end wall 34 includes a partially spherical concave recess 36. Further, a rigid disc 38 of a diameter substantially equal to the inside diameter of the end wall 34 is provided as well as one or more stiff but flexible discs 40 of abrasive material. Further, a cylindrical body 42 is also provided including one planar axial end face 44 and a second convex partial spherical end face 46.

The sleeve 22, cap 32 and body 42 may be constructed of suitable plastic or similar material and the disc 38 may be constructed of metal. Further, the disc 40 may comprise the conventional sandpaper having an abrasive on one side thereof. Also, it will be noted that the radius of curvature of the end face 46 is the same or slightly smaller than the radius of curvature of the recess 36.

Figure 6:
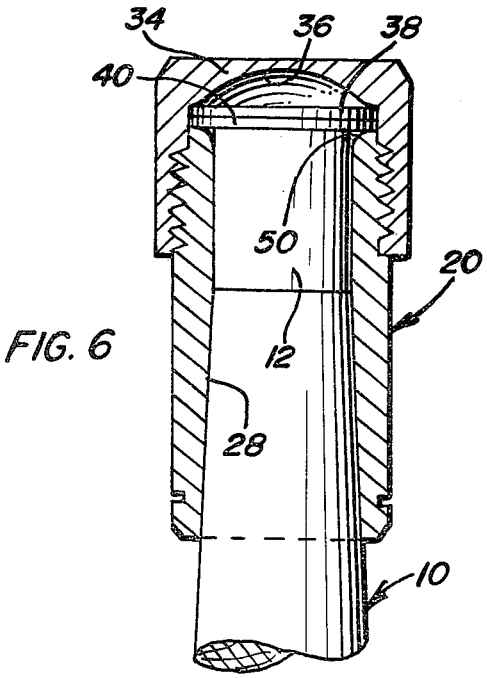
FIG. 6 is a fragmentary elevational view of the tip end of a cue stick with the tool of the instant invention illustrated in longitudinal section and operatively associated with the cue stick for squaring the end face of the ferrule.
Figure 7:
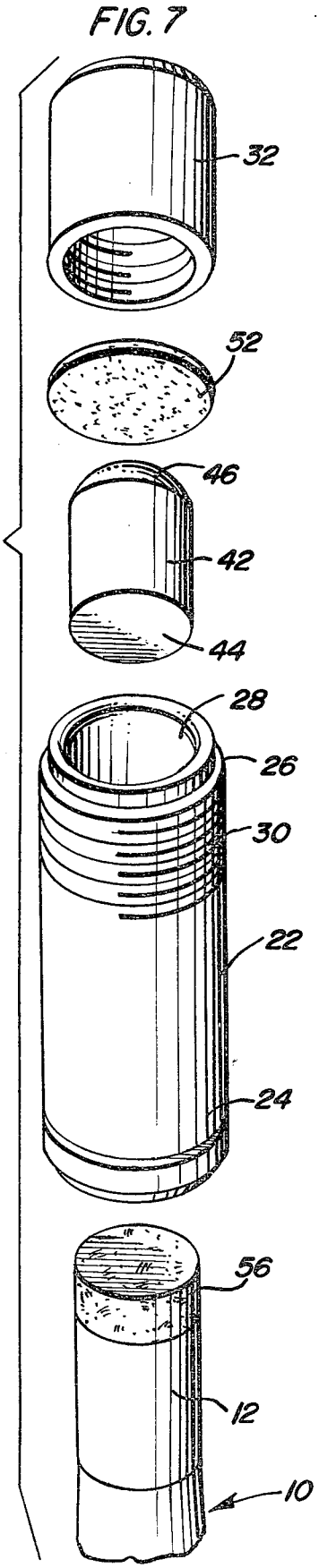
FIG. 7 is an exploded perspective view of the tool preparatory to assembly for the purpose of shaping the end face of a tip applied to the ferrule of a cue stick.

Assuming that the cue stick 10 has had its cue tip dislodged therefrom and that the outer face 16 of the ferrule 12 mounted on the stick 10 has glue or other adhesive remnants 18 thereon, when it is desired to smooth and square the face 16 prior to the attachment of a new cue stick tip thereto the tool 20 is assembled in the manner illustrated in FIG. 6 of the drawings with the disc 38 abutted against the outer periphery of the end wall 34 and the disc 40 abutted against the side of the disc facing away from the recess 36. When the tool 20 is thus assembled and the cap 32 is tightly threadedly engaged with the sleeve 22, the outer peripheral portions of the discs 38 and 40 are clamped between the outer periphery of the inner surface of the end wall 34 and the axial end face 50 of the second end 26 of the sleeve 22. In this manner, the discs 38 and 40 are tightly stationarily clamped against shifting relative to the tool 20 and the latter and the cue stick 10 may be relatively rotated in order to abrade the remnants 18 from the outer face 16 and to square the outer face 16 preparatory to the attachment of a new cue stick tip thereto.

Figure 8:
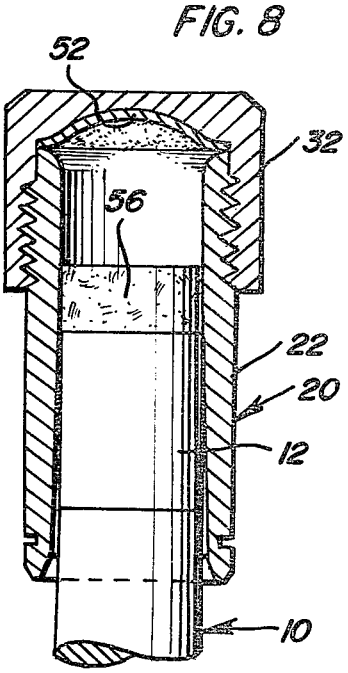
FIG. 8 is an assembled view of the tool and in initial operative association with a cue stick having a new tip mounted thereon preparatory to shaping the outer face of the tip.
Figure 9:
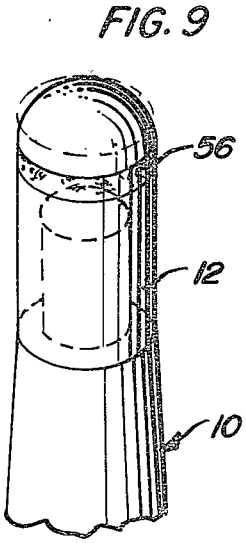
FIG. 9 is a fragmentary perspective view of the cue stick end after having the outer face of the cue tip shaped by the tool of the instant invention.

After the outer face 16 of the ferrule 12 has been cleaned and squared in the manner set forth above, the discs 38 and 40 may be removed from the tool 20 by the removal of the end cap 34 and a new abrasive disc 52 (alternately the old abrasive disc 40 may be used) is positioned between the outer periphery of the inside of the end wall 34 and the end face 50 of the second end 26 of the sleeve 22. However, the end wall 34 is not immediately tightened on the sleeve 22. Rather, the body 42 is positioned within the sleeve 22 and the cue stick 10, after having a new tip 56 mounted thereon subsequent to the cleaning and squaring of the outer face 16, is telescoped into the sleeve 22 behind the body 42 and axial pressure is applied between the tool 20 and the stick 10 in order to force the end face 46 of the body 42 into the recess 36 and thereby deflect the dics 52 to the position thereof illustrated in FIG. 8 of the drawings with the disc 52 conforming to the curvature of the recess 36. While such axial pressure is maintained, the cap 32 is tightened on the second end 26 of the sleeve 22 in order to clamp the thus formed disc 52 in position relative to the body or tool 20. Thereafter, the cue stick 10 may have its tip end removed from the second end 24 of the sleeve 22, the body 42 may be similarly removed from the sleeve 22 and the tip end of the cue stick 10 having the new tip 56 secured thereon may be reinserted in the sleeve 22 and positioned with the outer end face 58 of the tip 56 engaged with the formed disc 52. Thereafter, the body or tool 20 and stick 10 may be relatively rotated in order to enable the formed disc 52 to properly convexly shape the end face 58 of the tip 56 to the partially spherical convex configuration thereof illustrated in FIG. 9.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A tool for squaring a cue tip ferrule and shaping a subsequently applied cue tip, said tool including an abrasive disc, a rigid planar disc and body means defining an outwardly opening blind bore closed at its inner end by a generally partial spherical and outwardly concave end wall, said body means including means operative to clampingly engage and stationarily support said abrasive disc abutted against and conforming to the curvature of said end wall with at least the center portion of said disc fully exposed to the open end of said bore, said body means also including means operative to stationarily support said rigid and abrasive discs across the inner end of said blind bore with said abrasive disc abutted against, conforming to and overlying said rigid disc and fully exposed to the open end of said bore.

2. The tool of claim 1 wherein said body includes a sleeve body having first and second ends and defining a longitudinal bore extending therethrough and opening in an unobstructive manner through the first end of said sleeve, a cap removably threadedly secured over the second end of said sleeve and defining said end wall closing the corresponding end of said sleeve and transforming said longitudinal bore into said blind bore, the end face of said second end of said sleeve and the opposing outer peripheral portions of the inner side of said end wall defining clamping surfaces between which the outer peripheries of said abrasive and rigid discs may be selectively clampingly engaged.

3. The tool of claim 2 including an elongated abutment member slidingly receivable in said sleeve and including a first end equipped with a convex partial spherical surface of generally the same radius of curvature as the radius of curvature of said concave end wall, said abutment member being engageable with said abrasive disc for deflecting the latter into substantial surface-to-surface conformity to said concave end wall prior to clamping engagement of the outer peripheral portions of said abrasive disc between the outer peripheral portions of the inner surface of said end wall and the opposing end of said sleeve.

4. The method of cleaning and squaring the end face of a cue stick ferrule prior to the securement of a replacement cue tip thereto and shaping the outer end face of a subsequently applied tip into partial convex spherical configuration, said method comprising providing a body defining a blind bore with a planar inner end wall normal to the center of said bore and having an abrasive disc abutted thereagainst and stationarily supported therefrom in position facing outwardly of the outer end of said blind bore, telescoping said body over the ferrule equipped end of a cue stick with the end face of the ferrule axially engaged with said abrasive disc and thereafter relatively rotating said disc and body to abrade clean and square the end face of said ferrule, and after a tip has been applied to said cleaned and square end face of said ferrule, transforming said planar inner end wall into a concave partial spherical inner end wall, abutting a flexible abrasive disc against said concave spherical inner end wall in conformance to the shape thereof, tightly clamping the outer periphery portions of said disc relative to the outer peripheral portions of the last mentioned end wall and thereafter telescoping said body over the tip renewed end of the cue stick with the outer end face of the tip tightly frictionally engaged with the last mentioned abrasive disc and then relatively rotationing the body and said cue stick.

5. A tool for squaring a cue tip ferrule and shaping a subsequently applied cue tip, said tool including a sleeve defining first and second ends, said second end being externally threaded and having an internally threaded cap threadedly engaged thereover defining an end wall for the end of said bore opening outwardly of said second end of said sleeve, a rigid disc removably disposed in said cap between said end wall and the adjacent end of said sleeve, an abrasive disc removably disposed in said cap between said rigid disc and said adjacent sleeve end, said cap being removably threadedly tightened on said second end of said sleeve in a manner clampingly engaging said rigid and abrasive discs between the outer peripheral portions of said end wall and said adjacent sleeve end.

6. The tool of claim 5 wherein said end wall includes at least a central area of the inner surface thereof which is concave partial spherical in configuration, a second abrasive disc positionable between the outer peripheral portions of said end wall and the adjacent end of said sleeve when said rigid disc and the first mentioned abrasive disc are removed, an elongated abutment body longitudinally slidable in said sleeve and including a convex partial spherical end opposing said end wall outwardly of said disc and engageable with the latter to laterially deflect at least the central portion of said second abrasive disc, after said rigid disc is removed, into close conformity to the concave partial spherical configuration of the central portion of the inner surface of said end wall, the outer peripheral portions of said second abrasive disc being clampingly engageable between the outer peripheral portions of said end wall and the opposing end of said sleeve upon the tightening of said cap on said sleeve.

7. The tool of claim 6 wherein the inner marginal portions of the end of said sleeve opposing said end wall and the adjacent end of the bore extending through said sleeve are smoothly coextensively radiused.

8. A kit for squaring a cue tip ferrule and shaping a subsequently applied cue tip, said kit including a sleeve defining a longitudinal bore extending therethrough, one end of said sleeve being externally threaded, an internally threaded cup-shaped cap removably threadedly engageable over said one end of said sleeve, said cap defining an end wall for said sleeve including an inner surface, at least the central portion of the inner surface of said end wall including a concave partial spherical recess formed therein, a flat rigid disc seatable within said cap against the the outer peripheral portions of said end wall and clampingly engageable between the outer peripheral portions of said end wall and the axial end of said one end of said sleeve, at least one flexible disc having an abrasive surface on one side thereof receivable within said cap and selectively, clampably engageable between the end face of said one end of said sleeve and, alternatively, the outer periphery of said rigid disc or the outer periphery of said end wall, and an elongated abutment member slidingly receivable in said sleeve and including a first end equipped with a convex partial spherical surface of generally the same radius of curvature as the radius of curvature of said concave end wall, said abutment member being engageable with said abrasive disc for deflecting the latter into substantial surface-to-surface conformity to said concave end wall prior to clamping engagement of the outer peripheral portions of said abrasive disc between the outer peripheral portions of the inner surface of said end wall and the opposing end of said sleeve.

* * * * *